US005538290A

United States Patent [19]

Diamond

[11] Patent Number: 5,538,290

[45] Date of Patent: Jul. 23, 1996

[54] METHOD AND APPARATUS FOR INHIBITING THE COPYING OF CHECKS AND NEGOTIABLE DOCUMENTS

[75] Inventor: Robert I. Diamond, Bothell, Wash.

[73] Assignee: Formtronics, Inc., Highland, Utah

[21] Appl. No.: 241,798

[22] Filed: May 12, 1994

Related U.S. Application Data

[63] Continuation-in-part of Ser. No. 57,614, May 5, 1993, abandoned.

[51] Int. Cl.[6] ..... B42D 15/00

[52] U.S. Cl. ..... 283/113; 283/114; 283/58

[58] Field of Search ..... 283/57, 58, 113, 283/114, 72; 428/357, 199, 211

[56] References Cited

U.S. PATENT DOCUMENTS 1,383,792 7/1921 Dickinson ..... 283/114 X
4,210,346 7/1980 Mowry, Jr. et al. .
4,227,719 10/1980 McElligott et al. .
4,227,720 10/1980 Mowry, Jr. et al. .
4,265,469 5/1981 Mowry, Jr. et al. .
4,310,180 1/1982 Mowry, Jr. et al. .
4,341,404 7/1982 Mowry, Jr. et al. .
4,351,547 9/1982 Brooks, II .
5,085,936 2/1992 Herdman ..... 283/113 X

*Primary Examiner*—Willmon Fridie, Jr.
*Attorney, Agent, or Firm*—Michael A. O'Neil

[57] ABSTRACT

A method and apparatus for enhancing the security of a check or negotiable document and deterring the generation of copies of the check or negotiable document. The signature area of a document is imprinted with a pantographic background design different from a pantographic background design covering the remainder of the face of a check. A warning clause describes the color and/or background of the signature area. The endorsement area of a document is also imprinted with a pantographic background design. A warning clause describes the color and/or background of the endorsement area. The endorsement area background may further include a representation of the watermark certification seal to aid an individual in more quickly determining whether the proper watermark seal exist on the check or negotiable document.

23 Claims, 2 Drawing Sheets

METHOD AND APPARATUS FOR INHIBITING THE COPYING OF CHECKS AND NEGOTIABLE DOCUMENTS

RELATED APPLICATION

This application is a continuation in part of U.S. application Ser. No. 08/057,614, filed May 5, 1993, now abandoned and entitled METHOD AND APPARATUS FOR INHIBITING THE COPYING OF CHECKS AND NEGOTIABLE DOCUMENTS.

TECHNICAL FIELD

This invention relates to a method and apparatus for check copying protection, and more particularly to a method and apparatus for protecting the signature and endorsement areas of a check from copying by unauthorized individuals and for allowing an individual to quickly determine the validity of a check.

BACKGROUND OF THE INVENTION

A major problem within the check cashing industry is the increasing risks arising from the copying of checks by unauthorized individuals. These risks have increased due to the improved technology in the areas of copiers, computer aided design and desk top publishing. Advancements in these areas have created the ability to duplicate checks and other negotiable documents to such a high degree of accuracy that an individual receiving the check or negotiable document has difficulty in determining if the instrument is fraudulent.

A variety of methods have been implemented to protect against the unauthorized copying of checks and negotiable documents. These preventative methods have included the use of multi-colored check faces and specially designed check backgrounds that are not easily copied. Some manufacturers have utilized the placement of the word "void" in a muted design that normally blends in with the background of a check but becomes visible when the check is processed through a single or full color copier. Other manufacturers use a rainbow color scheme with graduated colors from blue to green or blue to purple across the face of a check or negotiable document. The rainbow color scheme makes the check more difficult to photocopy.

Another technique utilized to protect against fraudulent checks and negotiable documents is the placement of artificial watermark certification seals upon the check or negotiable document. The seals are only apparent to an individual when viewing a check or negotiable document from an angle. The watermark certification seals cannot be copied and a warning placed upon the check or negotiable document alerts an individual to the required presence of the watermark.

However, none of these security methods protect two particularly vital areas of a check or negotiable document. The most critical areas of a check or negotiable document are the signature area and the endorsement area on the back of the check. None of the methods to date have focused upon protection of these particularly vital areas. Another problem arises from the fact that the watermark certification seals placed upon the check or negotiable document are difficult to see, making it difficult for an individual cashing the check to easily determine whether the proper watermark seal is present. Thus, a need has arisen for a method and apparatus specifically protecting the vital signature and endorsement areas of a check or negotiable document and allowing an individual to more easily determine the presence of a watermark certification seal.

SUMMARY OF THE INVENTION

The foregoing and other problems are overcome by the present invention. The process generates a check or negotiable document wherein the signature area contains several verifications. These include a printed signature area background differing from the background design of the balance of the check. The signature area background may have a single or multi-color background. A warning clause describes the color and/or background design of the signature area, and is printed in a manner such that it is clearly visible prior to and after any unauthorized copying.

As part of the check printing process, verifications are included on the back of the check within the endorsement area. A background design, similar or different to the design on the front of the check, is printed within the check endorsement area. The design may be single or multi-colored and a warning clause is printed alerting payers of the check to the background and/or color scheme of the endorsement area, and is printed in a manner such that it is clearly visible prior to and after any unauthorized copying.

Finally, within the check endorsement area of the check or negotiable document, a representation of the watermark certification seal is included as part of the backing. This allows a payer of the check to quickly determine the appearance of the watermark certification seals located upon the document, and thus, more easily locate the watermarks.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION

Figure 1:
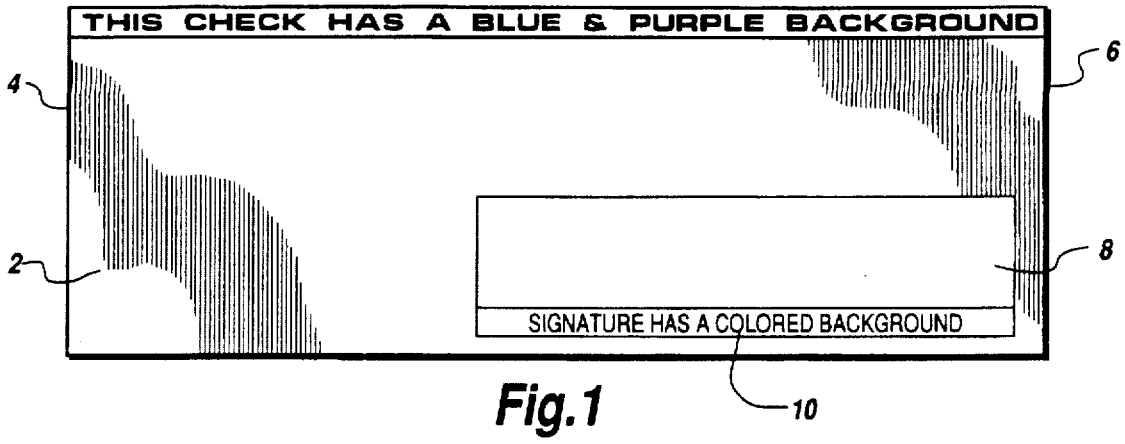
FIG. 1 illustrates the front side of a check utilizing the signature area of the present invention.

Referring now to the Drawings, and more particularly to FIG. 1, there is illustrated the front side of a check utilizing the signature area of the present invention. The check comprises a substantially rectangular sheet of paper having a check face 2, covered with a pantographic background design. As the pantographic background design proceeds from the left side 4 of the check to the right side 6 of the check, the color graduates from one color to other colors, for example, from blue to green or blue to purple. The signature area 8 of the check, comprises an area having a pantographic background design different from the design encompassing the majority of the face 2 of the check. Furthermore, as you proceed from the left side of the signature area to the right side of the signature area, a graduated color change can occur.

A warning clause 10 is placed in the signature area 8 indicating that the signature area has a colored background. The warning clause may also include an indication of the differing background within the signature area 8, refer to the presence of a watermark certification seal located somewhere on the check or describe any other relevant feature of the signature area. The warning clause 10 uses a background and print that is clearly visible prior to and after any unauthorized copying. In the preferred embodiment, this would be achieved by using a solid color background, as opposed to a pantographic background design, with the warning clause 10.

Figure 2:
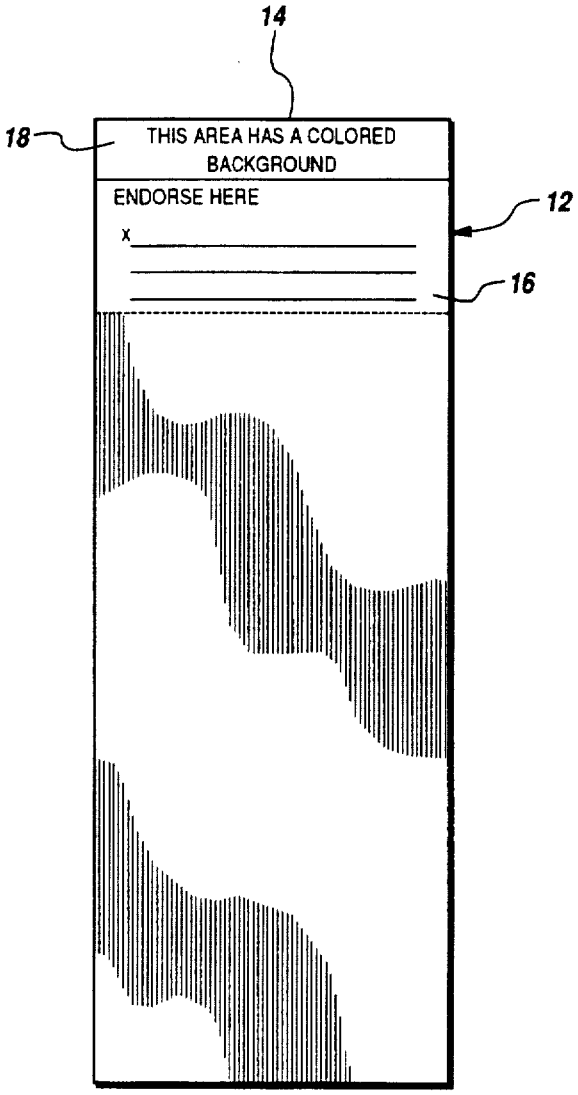
FIG. 2 is an illustration of the back of a check utilizing the endorsement area of the present invention.

Referring now to FIG. 2, there is shown the back of a check having an endorsement area printed or manufactured in accordance with the present invention. The endorsement area 12 comprises an area located at the top edge 14 of the check. The face 16 of the endorsement area 12 is covered by a pantographic background design similar to the pantographic background design on the face 2 of the check. The pantographic background design may be a single color or alternatively, may have multi-colors fading from one color to the other colors across the face 16 of the endorsement area 12.

A warning clause 18 across the top of the endorsement area 12 describes the color and/or background of the endorsement area. The warning clause 18 may further describe any relevant aspect of the endorsement area 12 and the face of check 2. The warning clause 18 is printed using a background and print that is clearly visible prior to and after any unauthorized copying. In the preferred embodiment, this would be achieved by using a solid color background, as opposed to a pantographic background design, with the warning clause 18. While the description with respect to FIGS. 1 and 2 were made with respect to a check, it is to be understood that the invention is applicable to any negotiable document.

Figure 3:
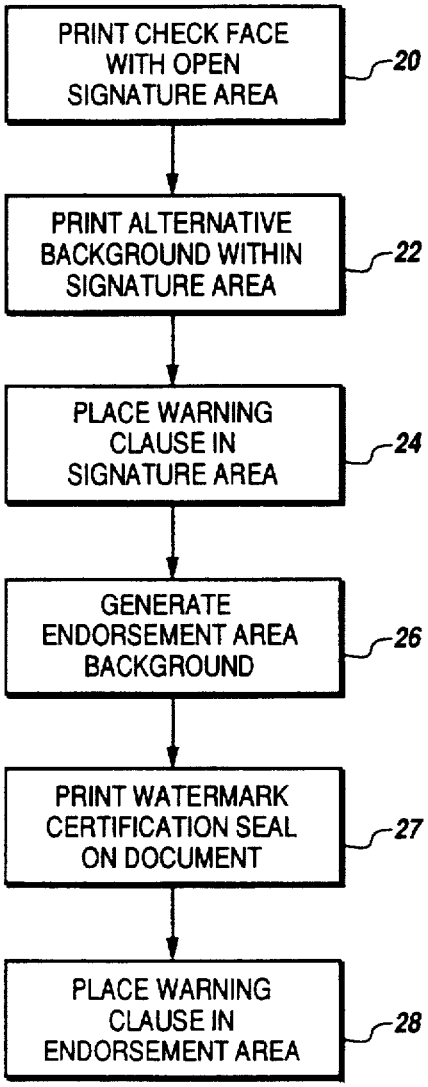
FIG. 3 is a flow diagram describing the process of the present invention.

Referring now to FIG. 3, there is shown a block diagram illustrating the process of the present invention. The check face is printed at step 20. At step 22, the signature area is also printed with an alternative background and a color scheme similar to that of the remainder of the face of the check. At step 24, the warning clause is placed in the signature area of the check to describe the background and/or color of the signature area. The endorsement area background is generated at step 26 within the endorsement area to have a pantographic background design similar to the design on the front of the check. The watermark certification seal representation is printed on the check at step 27 to provide an individual with a quick reference as to the appearance of the watermark certification seals printed on the check. The representation will normally be placed within the endorsement area but this is not required. A warning clause is placed at step 28 in the endorsement area of the check to describe the background and/or color of the endorsement area.

Figure 4:
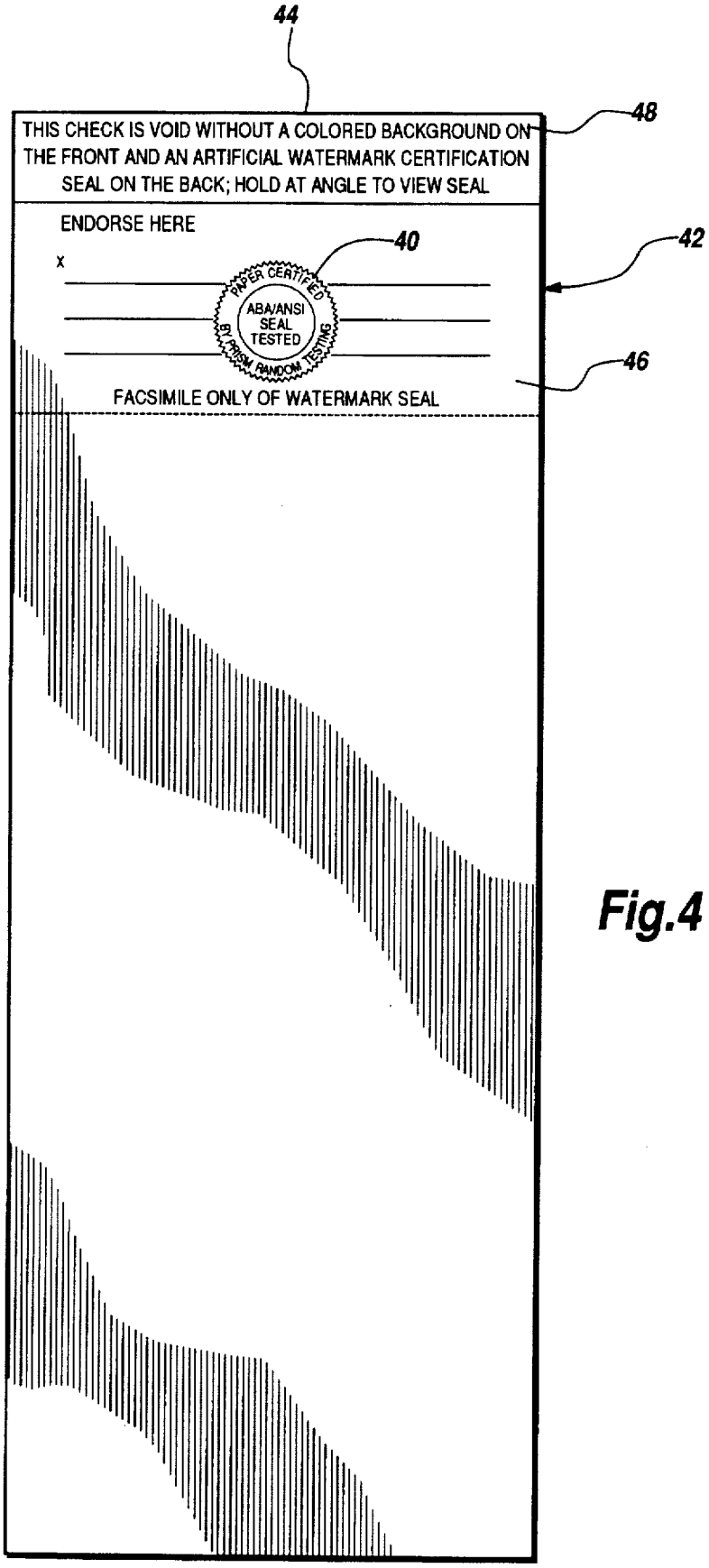
FIG. 4 is an illustration of an alternative embodiment of the back of a check having an endorsement area containing a representation of the watermark certification seals incorporated onto the check.

Referring now to FIG. 4, there is shown an alternative embodiment of the present invention wherein a watermark certification seal representation 40 is incorporated into the background of the check endorsement area 42. As before, the endorsement area 42 comprises an area located at the top edge 44 of the check. The face 46 of the endorsement area 42 is covered by a pantographic background design similar to the pantographic background design on the front face 2 (FIG. 1) of the check. At some location within the endorsement area 42, the watermark certification seal representation 40 is included. The watermark certification seal representation 40 is a replica of the artificial watermark certification seals (not shown) placed upon other locations of the check or negotiable document. A notification 41 placed at the bottom of the endorsement area 42 notifies a user that the watermark certification seal representation 40 is only a facsimile of the actual watermark certification seal (not shown). By placing the watermark certification seal representation 40 within the endorsement area 42, an individual can quickly determine what they are looking for when trying to ascertain the existence of an artificial watermark certification seal in other locations on the check. As in FIG. 2 a warning clause 48 notifies users of various security features used on the check.

Although preferred embodiments of the present invention have been illustrated in the accompanying Drawings and described in the foregoing Detailed Description, it will be understood that the invention is not limited to the embodiments disclosed, but is capable of numerous rearrangements, modifications and substitutions of parts and elements without departing from the spirit of the invention.

I claim:

1. A negotiable document having enhanced security for deterring generation of copies of the negotiable document, comprising:

a backing having an artificial watermark certification seal; and a visually perceptible watermark certification seal representation located on the backing for comparison with the artificial watermark certification seal to determine validity of the negotiable document.

2. The negotiable document of claim 1, wherein the representation is located within an endorsement area of the negotiable document.

3. The negotiable document of claim 1 further including:

an endorsement area on a first side of the backing for endorsing the negotiable document; and a pantographic background design substantially covering the endorsement area of the negotiable documents, said pantographic background design having a single color.

4. The negotiable document of claim 3, wherein the pantographic background design is multicolored.

5. The negotiable document of claim 3, wherein the endorsement area further includes a warning clause describing the pantographic background design of the endorsement area.

6. The negotiable document of claim 5, wherein the warning clause describes the color of the pantographic background design.

7. The negotiable document of claim 1 further including:

a signature area on a second side of the backing; and a pantographic background design substantially covering the signature area and differing from a pantographic background design on the second side of the backing.

8. The negotiable document of claim 7, wherein the pantographic background design of the signature area is multicolored.

9. The negotiable document of claim 7, wherein the signature area further includes a warning clause describing the pantographic background design of the signature area.

10. The negotiable document of claim 9, wherein the warning clause describes the color of the pantographic background design.

11. A negotiable document having enhanced security for deterring generation of copies of the negotiable document, comprising:

a backing having an artificial watermark certification seal;

a watermark certification seal representation on the backing for comparison with the artificial watermark certification seal to determine validity of the negotiable document;

an endorsement area on a first side of the backing for endorsing the negotiable document;

a pantographic background design substantially covering the endorsement area, said pantographic background having a single color;

a signature area on a second side of the backing; and a pantographic background design substantially covering the signature area and differing from a pantographic background design on the second side of the backing.

12. The negotiable document of claim 11, wherein the representation is located within the endorsement area of the negotiable document.

13. The negotiable document of claim 12, wherein the pantographic background of the endorsement area is multi-colored.

14. The negotiable document of claim 11, wherein the endorsement area further includes a warning clause describing the pantographic background design of the endorsement area.

15. The negotiable document of claim 14, wherein the warning clause describes the color of the pantographic background design.

16. The negotiable document of claim 11, wherein the pantographic background design of the signature area is multi-colored.

17. The negotiable document of claim 11, wherein the signature area further includes a warning clause describing the pantographic background design of the signature area.

18. The negotiable document of claim 17, wherein the warning clause describes the color of the pantographic background design.

19. A method for enhancing security of a negotiable document and deterring copying of the negotiable document, comprising the steps of:

generating an artificial watermark certification seal on the negotiable document; and placing a visually perceptible watermark certification seal representation on the negotiable document.

20. The method of claim 19, further including the step of placing the watermark certification seal representation in an endorsement area of the negotiable document.

21. The method of claim 19 further including the steps of:

printing a first pantographic background design within a signature area;

printing a second pantographic background design substantially covering a first side of the negotiable document and differing from the first pantographic background design; and generating a warning clause describing the pantographic background design of the signature area.

22. The method of claim 19, further including the step of printing a pantographic background design within an endorsement area on a second side of the negotiable document.

23. The method of claim 22, further including the step of generating a warning clause describing the pantographic background design within the endorsement area.

* * * * *

UNITED STATES PATENT AND TRADEMARK OFFICE

CERTIFICATE OF CORRECTION

PATENT NO. : 5,538,290

DATED : July 23, 1996

INVENTOR(S) : Robert I. Diamond

It is certified that error appears in the above-indentified patent and that said Letters Patent is hereby corrected as shown below:

On the title page item [57],

Abstract, line 14, replace "exist" with --exists--.

Signed and Sealed this

Twenty-ninth Day of April, 1997

*Attest:*

*Attesting Officer*

BRUCE LEHMAN

*Commissioner of Patents and Trademarks*